United States Patent [19]

Seifert et al.

[11] 4,106,980

[45] Aug. 15, 1978

[54] THICKENER APPARATUS INCLUDING A SHAFTLESS CYLINDER MOLD

[75] Inventors: Peter Seifert; Walter R. Zimmerman, both of Middletown, Ohio

[73] Assignee: The Black Clawson Company, Middletown, Ohio

[21] Appl. No.: 795,703

[22] Filed: May 11, 1977

[51] Int. Cl.[2] ..... D21F 1/04; D21F 1/60

[52] U.S. Cl. ..... 162/330; 162/335; 162/357; 210/402

[58] Field of Search ..... 162/323, 330, 335, 357; 210/402; 29/121.3, 123

[56] References Cited

U.S. PATENT DOCUMENTS

| | | | |
|---|---|---|---|
| 2,510,254 | 6/1950 | Richter | 210/402 X |
| 3,091,563 | 5/1963 | Meyer | 162/357 X |
| 3,577,315 | 5/1971 | Franklin | 162/357 X |
| 3,773,614 | 11/1973 | Pennington | 162/357 |
| 3,781,957 | 1/1974 | Luthi | 29/121.3 |

*Primary Examiner*—Richard V. Fisher
*Attorney, Agent, or Firm*—Biebel, French & Nauman

[57] ABSTRACT

A thickener apparatus includes a shaftless cylinder mold having a perforated cylindrical shell supported by two end members one of which is an open frame structure having radially extending support beams interconnecting a short rotational shaft aligned with the axial center of rotation of the cylinder, and a peripheral ring member which supports the shell of the cylinder mold. The shell is sufficiently rigid to be self supporting and has a backing cloth overly covering the perforated portion of the cylinder, and a face cloth covering the backing cloth, both of which act as a screen to permit the white water to collect in the central hollow portion of the cylinder mold to be subsequently discharged therefrom.

2 Claims, 6 Drawing Figures

THICKENER APPARATUS INCLUDING A SHAFTLESS CYLINDER MOLD

BACKGROUND OF THE INVENTION

1. Field of the Invention

The present invention relates to thickening apparatus, paper making machines and the like, used in the paper making industry and more particularly, to a cylinder mold for use in a thickening apparatus.

2. Prior Art

In the paper making industry, a device commonly referred to as a thickener or decker basically comprises a vat with a controlled infeed and a discharge outlet, and a cylinder mold, namely a cylindrical porous shell, is suspended for rotation in the vat and with the hollow central portion of the shell in communication with a white water discharge outlet. As the cylinder mold is rotated, the fibers in the pulp slurry adhere to the porous surface of the cylinder mold and water is discharged through the mold into the hollow center from where it is subsequently removed, depositing a dewatered fibrous web on the outer surface of the mold. A couch roll in contact with the surface of the cylinder mold then removes the fibrous web in a well known manner for its subsequent processing into paper.

The cylinder mold, which plays a very important part in the thickener apparatus, is usally constructed with a long solid steel center shaft with a plurality of spaced, spoked support members upon which a spirally wound wire or screen mesh is supported, to form the outer surface of the cylinder mold. Cylinder molds constructed in this manner are very expensive and relatively heavy because of the large central shaft utilized to support the mold. A major difficulty associated with such prior art devices is that since the outer porous shell is relatively flexible and thin, it is often deformed during use because the heavy central shaft causes the shell to deflect more than it normally would due to its own weight, since the heavy shaft will deflect more than the shell.

Attempts have been made to overcome this difficulty be development of shaftless cylinder molds of a variety of constructions. Such constructions are disclosed, for example, in U.S. Pat. Nos. 3,091,563, 3,577,315, and 3,773,614. These devices use a variety of forms to support the shell and give the cylinder mold the necessary rigidity to remain substantially cylindrical during use.

SUMMARY OF THE INVENTION

The present invention provides a new and novel shaftless cylinder mold with a perforated shell which is rigid enough to be substantially self supporting and which is supported at its end portions by rigid frame structures, one of which is substantially open so that the internal hollow portion of the cylinder mold can be in constant communication with a white water discharge outlet.

The perforated shell of the present invention is preferably covered with a backing cloth which covers the perforations on the outer surface of the shell, and which in turn is overly covered by a face cloth, both of which are secured at the end portions of the shell to the cylinder mold. The one end portion of the cylinder mold which is open is supported by a frame structure comprising a plurality of equal angularly spaced beams extending radially outward from a central hub or shaft coaxially aligned with the axis of rotation of the cylinder mold, and th outer edges of the beams are secured to a ring, the outer periphery of which supports the perforated shell member. The opposite end of the cylinder mold is closed in order to prevent communication between the fibrous slurry and the white water being discharged through the central hollow portion of the cylinder mold.

A plurality of stiffening rings are also preferably provided equally spaced between the two end members and in engagement with the inner surface of the shell to provide additional support therefor, the ring members being entirely open in the central portion and having their outer peripheries in engagement with the inner surface of the shell.

DETAILED DESCRIPTION OF THE PREFERRED EMBODIMENT

Figure 1:
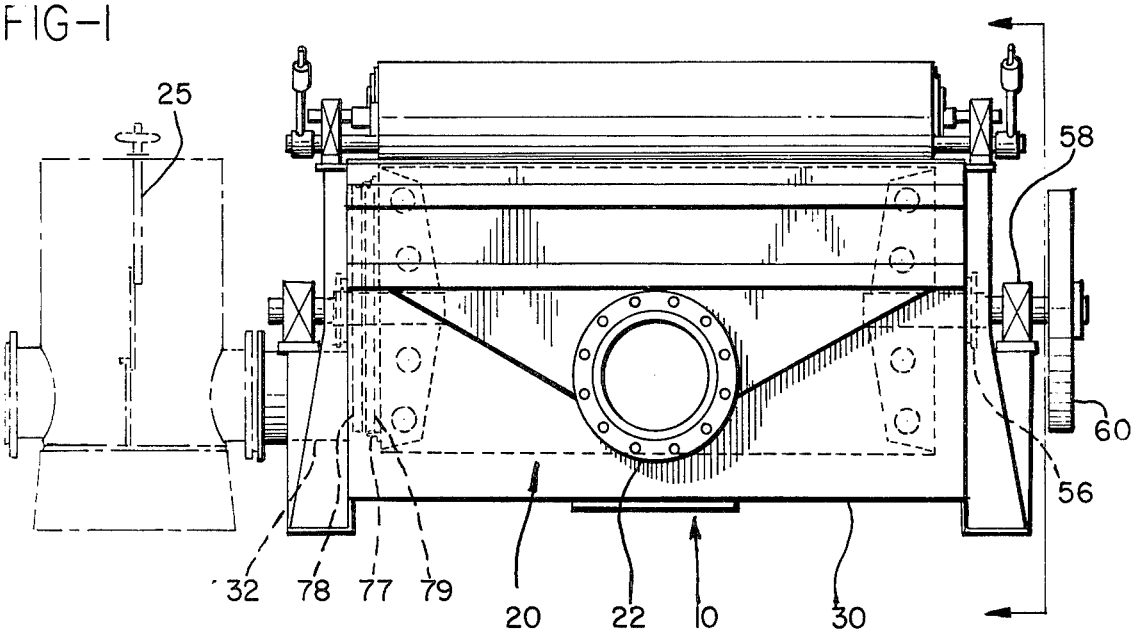
FIG. 1 is a side elevational view of a thickener device containing a preferred embodiment of the cylinder mold of the present invention.
Figure 2:
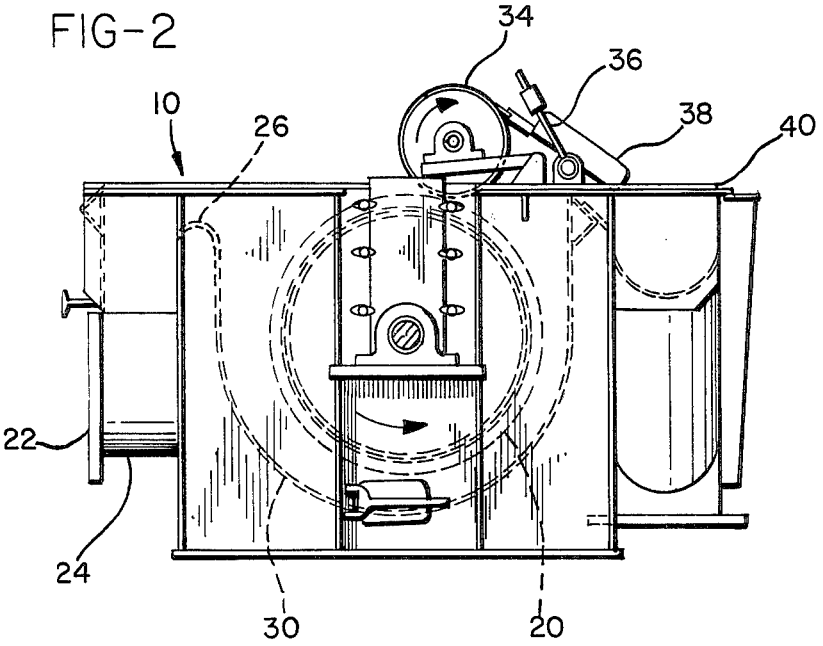
FIG. 2 is a side elevational view of the thickener device of FIG. 1.

The thickener 10 illustrated in FIG. 1 is of conventional construction with the exception of the cylinder mold 20 which is the subject of the present invention.

Generally, the thickener 10 comprises a fibrous slurry input 22 through which the material enters the thickener. Immediately inside the housing in communication with the slurry input 22 is a chamber 24 in which the slurry is allowed to stabilize and rise slowly after the turbulent flow in through the slurry input. At the top of the chamber 24 is a weir 26 extending horizontally for substantially the entire length of the cylinder mold 20.

The vat 30, which has a semi-cylindrical lower portion concentric with the cylinder mold 20, is only partially filled with slurry. As the cylinder mold rotates, the pressure head developed in the vat 30 causes the water to be forced through the porous surface of the cylinder mold 20, and the white water will then be discharged through the hollow central portion of the cylinder mold to a discharge outlet 32 at one end of the thickener. The white water level in the cylinder mold 20 is controlled by the adjustable gate 25. As the white water passes through the surface of the cylinder mold 20, a fibrous web is formed on the surface of the cylinder mold as it rotates and is thus brought up out of the slurry where it comes in contact with a smooth couch roll 34. The couch roll 34 is of conventional construction and removes the fibrous web from the surface of the cylinder mold 20 in a well known manner.

Riding on the surface of the couch roll opposite the contact point with the cylinder mold 20 is a scraper member 36 commonly referred to as a doctor, which removes the web from the couch roll. The web then passes down the tray 38 into a collection box 40 from which it can be removed for subsequent use in the paper making process.

Figure 3:
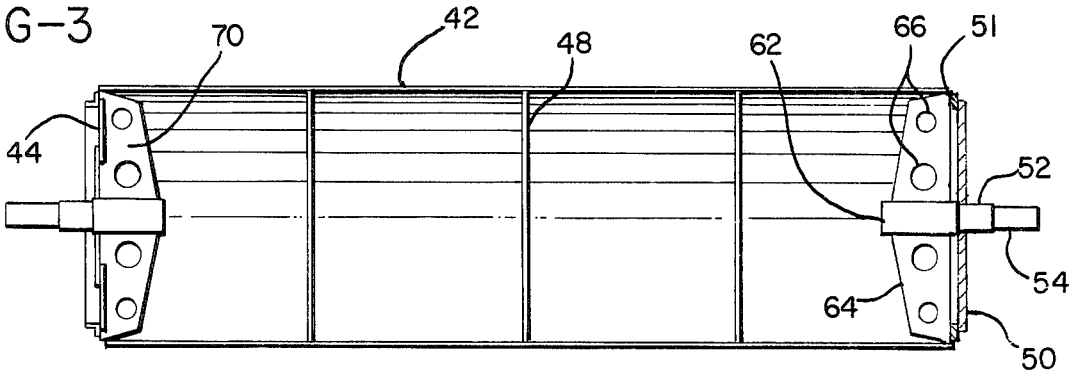
FIG. 3 is a side cross sectional view of the preferred embodiment of the cylinder mold of the present invention.
Figure 4:
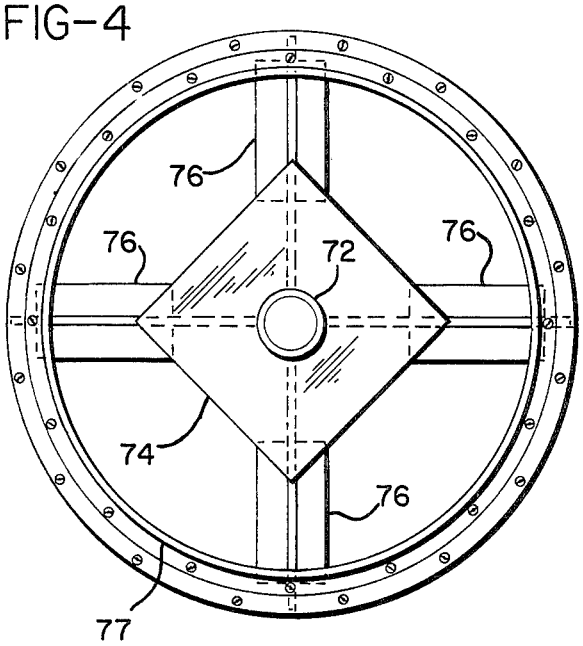
FIG. 4 is an end view of the open end of the preferred embodiment of the present invention.
Figure 5:
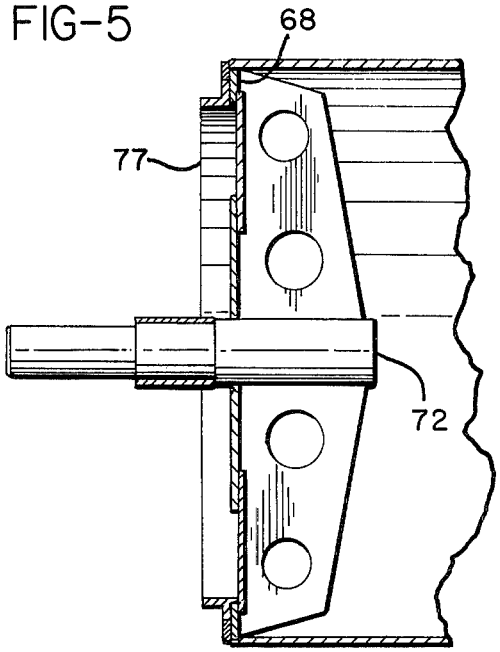
FIG. 5 is a side view in cross section of the open end portion of the preferred embodiment of the present invention.

Having generally described the thickening aparatus 10, reference will now be made to the novel cylinder mold 20 of the present invention which is utilized in the thickener. Referring particularly to FIGS. 3–5, the general construction of the cylinder mold 20 of the present invention comprises a cylindrical perforated shell member 42 supported at each end by frame structures comprising end members 44 and 46, and given additional stiffness by use of a plurality of stiffening rings 48 at equally spaced positions between the end members 44 and 46.

End member 46 is the closed end of the cylinder mold 20 and is constructed of a cover plate 50 secured to a ring member 51 in engagement with the inner surface of shell member 42, such as by welding or the like, to enclose and make water tight that end portion of the cylinder mold. Cover 50 is concentrically supported by a hub member 52 and is secured thereto in a water tight manner. Secured within hub 52 is a rotational support shaft 54 which, as seen in FIG. 1, extends through the end of the vat 30 through a sealing ring 56 and into a pillow block bearing 58. On the outer end of the shaft 52 is a drive wheel 60 which is driven by a remote motor (not shown).

Referring again to FIG. 3, the end 62 of hub portion 52 has secured thereto a plurality of thin beams 64 which in the preferred embodiment comprise four beams equally spaced at 90° about the hub 52 and in engagement with ring member 51 to provide rigid support for that end of the cylinder mold. The beams 64 are made as light as possible without destroying their structural stiffness, by providing holes 66 therein.

The open end 44 of the cylinder mold 20 is best seen in FIGS. 4 and 5. Open end 44 is constructed of a ring member 68 to which the perforated shell 42 is secured such as by welding or the like. A plurality of beams 70, identical to beams 64 used on end 51, extend from a central hub 72 outward to ring 68 and are secured thereto at each end by welding. In addition, a square plate 74 is secured to the hub member 62, and each corner of the plate is aligned with a beam 70, with the square being welded along the beam. Rectangular pieces 76 are also provided to add stiffening support to end member 44. The rectangular pieces 76 are centered so as to extend radially along each beam and are welded thereto.

A cylindrical ring 77 is secured to the outer surface of ring 68 and is disposed in abutting relationship to a corresponding ring 78 secured to the inner wall of vat 30. Surroundingly engaging rings 77 and 78 is adjustable cylindrical seal ring or garter strap 79, which together form a water tight seal against the inner wall of vat 30 to prevent slurry from entering the hollow central portion of the cylinder mold 20.

This construction gives substantial rigidity to the end member 44 and yet maintains a substantial open portion about the entire end as can best be seen in FIG. 4. Naturally, although this construction serves the desired purpose, other variations in the frame structure could be utilized so long as sufficient opening is provided to the white water discharge 32 from the hollow central portion of the cylinder mold 20 so that the flow of white water out of the cylinder through the discharge is not restricted. The present construction provides approximately one-third of the area of the cylinder mold 20, open to the discharge outlet 32 and is believed to be sufficient.

Figure 6:
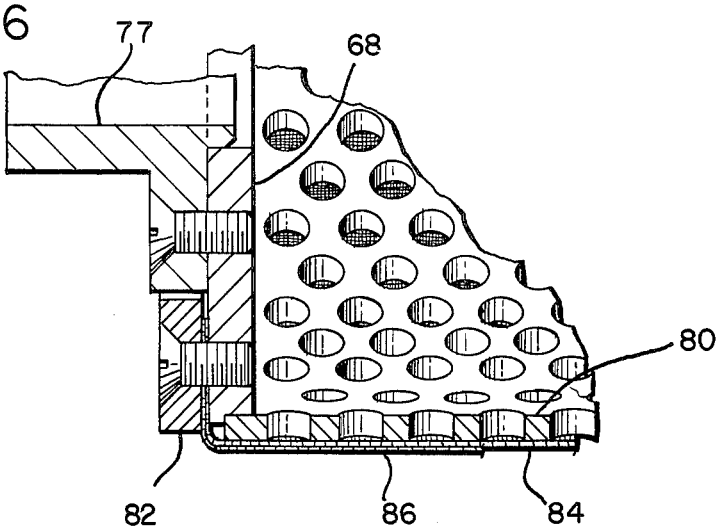
FIG. 6 is an enlarged broken out cross sectional view of the connection between the perforated shell and open end member of the preferred embodiment of the present invention.

The construction of the perforated shell member 42 is best seen in FIG. 6. The shell 42 comprises an inner cylindrical metal perforated cylinder 80 which is designed to have sufficient rigidity to be substantially self supporting when secured at its end portions to end members 44 and 46. Secured to the end portions 44 and 46 by a hold down ring 82 are a backing cloth 84 and a face cloth 86 which together comprise a screening means for exactly controlling the amount of water removed from the slurry while prohibiting the slurry from being discharged into the hollow central portion of the cylinder mold 20. In addition, the face cloth 86 provides the necessary friction for holding the web formed by the fiber slurry thereto until it is removed by the couch roll 34.

The looseness of the weave of backing cloth 84 and face cloth 86 can be varied to provide the necessary openings therein for allowing the water to be removed from the fiber slurry to form the fiberous web, depending upon the consistency of the slurry. This is accomplished by simple trial and error, and the necessary weaves for common consistencies of slurry are known in the art.

Although the perforated metal shell 80 can be designed to be completely self supporting, additional stiffener members 48 are preferably provided in order to reduce the necessary thickness of the roll of the perforated shell and thus make the cylinder mold substantially lighter without sacrificing rigidity. The stiffener members 48 are merely a plurality of equally spaced open rings secured to the inner surface of the shell 80 to prevent the shell from losing its cylindrical shape during extended use.

As an example of the appropriate thickness of the shell member 80, a cylinder mold was constructed having a 36 inch diameter shell 60 inches long. A wall thickness for the metal shell 80 of 0.187 inch was sufficient to provide the desired rigidity. The I-beams 64 and 70 were made of $\frac{3}{8}$ inch stainless steel plate, and the rings 51 and 68 and stiffening rings 48 were all $\frac{1}{2}$ inch thick and 2 $\frac{1}{2}$ inches in width.

This construction is believed to be sufficiently rigid to be self supporting without the need for an internal shaft, and is substantially lighter and more economical to produce than the prior art devices. It should be understood, however, that the present invention is not intended to be limited by these specific dimensions since the required thickness of the perforated shell 80, beams 64 and 70 and stiffening rings 48 can be varied to provide the necessary rigidity by applying well known engineering principles. However, for applications of the type to which the present invention is concerned, it is believed that the wall thickness will vary between 3/16 of an inch to $\frac{1}{2}$ inch, as opposed to prior art cylinder molds supported on a shaft which were generally over 1 inch in thickness.

Although the foregoing illustrates the preferred embodiment, many variations are possible. All such variations as would be obvious to one skilled in this art are intended to be included within the scope of the invention as defined by the following claims.

What is claimed is:

1. In a thickening apparatus for thickening wood pulp, having a thickening vat, a slurry input, means for providing a controlled supply of supply slurry to said thickening vat, a cylinder mold rotatably supported within said vat, a white water outlet at one end of the cylinder mold for removing white water from the interior of the cylinder mold, a couch roll in driven engagement with the surface of the cylinder mold for removing the thickened slurry from the cylinder mold, and a thickened slurry discharge device for removing the thickened slurry from the couch roll, the improvement comprising:

said cylinder mold having opposed axially aligned end support members with outer cylindrical peripheral surfaces, one of said end members disposed opposite said white water outlet being closed to prevent mixing of the slurry in said vat and white water in said cylinder mold, and the second of said end members adjacent said white water outlet having an open portion extending around substantially said entire second end member so that the interior of said cylinder mold is in communication with said white water outlet to permit white water to flow from the cylinder mold into said white water outlet while said cylinder mold is rotating, each of said end members having separate axially aligned rotation shafts secured thereto by which said cylinder mold is rotatably supported in said vat;

a cylindrical perforated shell member circumferentially secured to said end support members, for rotation therewith, and screening means covering the outer surface of said shell member for controlling the water removal from the slurry into the interior of said cylinder mold;

a plurality of stiffening members disposed in axially spaced relation between said end members supportively engaging the inner surface of said shell member and having openings defined therein for flow of white water from said first end member to said second end member; and said shell member being sufficiently rigid to be self-supporting in conjunction with said stiffening members.

2. A thickening apparatus as defined in claim 1 wherein said screening means comprises:

a backing cloth secured to said shell member and covering said perforations therein; and a face cloth covering said backing cloth and secured to said shell member.

* * * * *